United States Patent [19]

Bewley

[11] Patent Number: 5,031,267

[45] Date of Patent: Jul. 16, 1991

[54] VACUUM CLEANER BELT TENSIONER

[75] Inventor: Wilbur C. Bewley, Lexington, Ky.

[73] Assignee: Whirlpool Corporation, Benton Harbor, Mich.

[21] Appl. No.: 637,928

[22] Filed: Jan. 8, 1991

Related U.S. Application Data

[63] Continuation of Ser. No. 223,888, Jul. 21, 1988, abandoned.

[51] Int. Cl.[5] ..... A47L 9/04

[52] U.S. Cl. ..... 15/377; 15/389; 474/135

[58] Field of Search ..... 15/377, 389, 390; 474/101, 135

[56] References Cited

U.S. PATENT DOCUMENTS

| | | | |
|---|---|---|---|
| 959,667 | 5/1910 | White | 474/135 X |
| 1,074,562 | 9/1913 | Tirrill | 474/135 X |
| 1,192,317 | 7/1916 | Illingworth | 474/135 |
| 3,284,830 | 11/1966 | Kroll | 15/389 |
| 4,375,117 | 3/1983 | Lyman | 15/389 X |

FOREIGN PATENT DOCUMENTS

| | | | |
|---|---|---|---|
| 273831 | 7/1927 | United Kingdom | 15/389 |

*Primary Examiner*—Frankie L. Stinson

*Attorney, Agent, or Firm*—Jeffers, Hoffman & Niewyk

[57] ABSTRACT

A belt tensioner for a vacuum cleaner includes a roller and a torsion spring to bias the roller against an endless, non-stretch, flat vacuum cleaner belt to exert an increasing force thereon as the belt lengthens with wear and the torsion spring unwinds, thereby maintaining the tension in the belt substantially constant as the belt lengthens with wear. The tensioner includes a pair of connecting arms each having a first end coupled to opposite ends of the roller and each having a second end pivotal about a pivot axis, the torsion spring being disposed adjacent to the second ends of the connecting arms. The spring rate of the torsion spring is relatively low so that the moment about a pivot axis through the center of the torsion spring of the force applied to the connecting arms by the free end of the torsion spring decreases only slightly as the belt lengthens with wear.

16 Claims, 1 Drawing Sheet

VACUUM CLEANER BELT TENSIONER

This is a continuation of application Ser. No. 223,888, filed July 21, 1988, now abandoned.

BACKGROUND OF THE INVENTION

1. Field of the Invention

The present invention relates to a vacuum cleaner and, more particularly, to a vacuum cleaner belt tensioner that provides constant belt tension with an increasing force on the belt as the belt lengthens with wear.

2. Description of the Prior Art

Known vacuum cleaners include a beater brush coupled by a belt to a beater brush drive motor that imparts rotation to the beater brush. As the belt wears, it lengthens and becomes less effective in coupling the beater brush to the drive motor. In order to maintain the coupling between the beater brush and the drive motor, known vacuum cleaners typically include a device for tensioning the belt. However, such known belt tensioners are somewhat inadequate in that the tension in the belt produced by such devices typically varies as the belt slackens or lengthens with wear. Low belt tension often decreases the life of the belt and high belt tension decreases the life of the bearings in the motor and beater brush dowel. It is important to the life of these parts that a minimum tension be maintained in the belt and that the maximum tension in the belt be limited.

SUMMARY OF THE INVENTION

In accordance with the present invention, the disadvantages of prior art vacuum cleaner belt tensioners have been overcome. The vacuum cleaner belt tensioner of the present invention provides constant belt tension as the belt lengthens with wear and includes a spring wound to bias the tensioner against the belt so as to exert an increasing force on the belt as the belt lengthens with wear and the spring unwinds.

More particularly, the vacuum cleaner belt tensioner includes a roller mounted on an axle for engaging the vacuum cleaner belt and a pair of connecting arms each coupled at one end to the respective roller axle ends and mounted to a pivot axis at its opposite end. The spring of the tensioner is a torsion spring coupled to the pivot axis for biasing the roller against the vacuum cleaner belt to exert an increasing force thereon as the moment of the force about the pivot axis of the connecting arms decreases.

The vacuum cleaner belt tensioner of the present invention maintains the belt tension constant as the belt lengthens with wear so as to prolong the life of the belt as well as the bearings in both the drive motor and beater brush dowel. Further, by varying the length of the connecting arms to vary the maximum moment of the force about the pivot axis and/or by selecting a spring with an appropriate spring rate, various belt tensions may be obtained by the tensioner of the present invention. By effectively maintaining constant belt tension as belts lengthen with wear, endless, smooth drive belts may be used, that is, belts without formed teeth or cogs.

These and other objects, advantages and novel features of the present invention, as well as details of an illustrative embodiment thereof, will be more fully understood from the following description and the drawing.

DESCRIPTION OF THE PREFERRED EMBODIMENT

Figure 1:
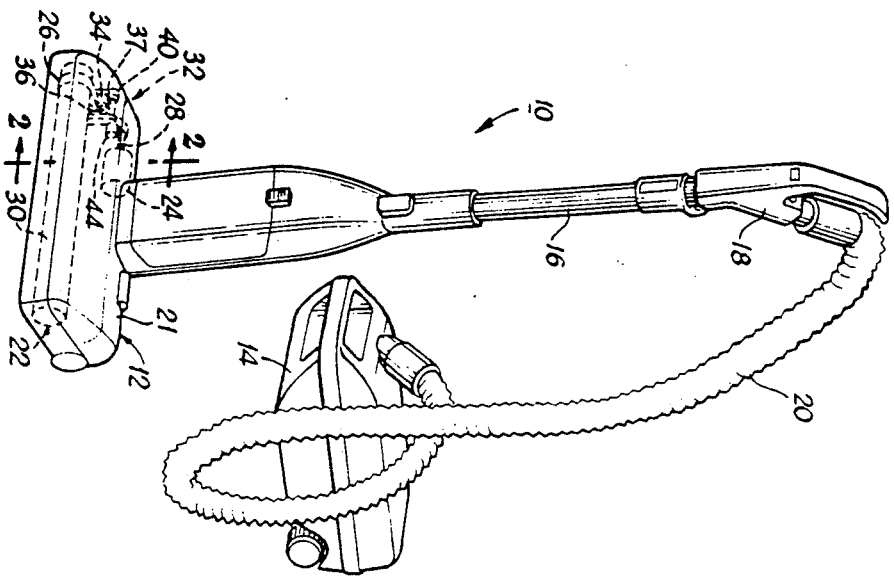
FIG. 1 is a perspective view of a vacuum cleaner constructed in accordance with the principles of the present invention.
Figure 4:
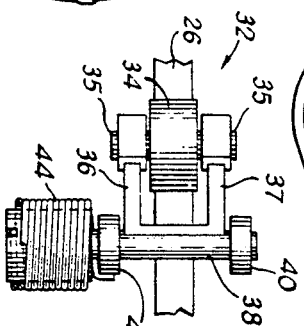
FIG. 4 is a top view of the belt tensioner of the present invention.
Figure 2:
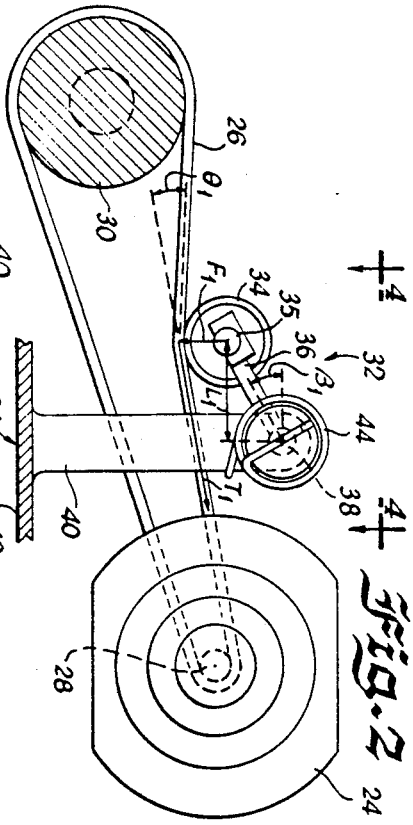
FIG. 2 is a side view illustrating the position of the belt tensioner of the present invention for a new belt.
Figure 3:
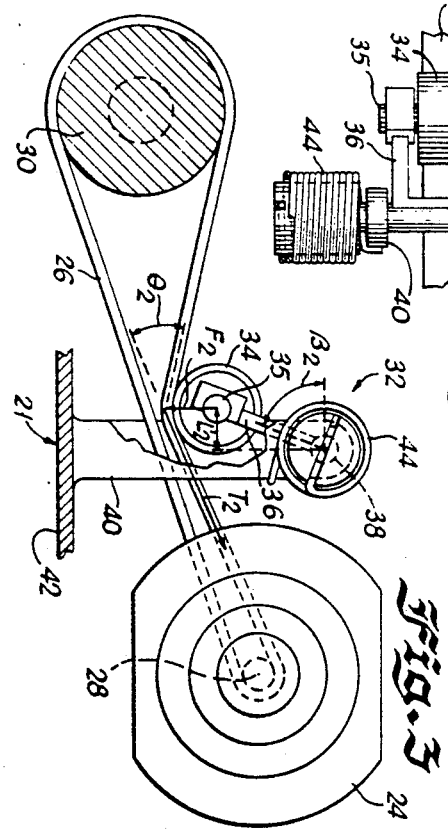
FIG. 3 is a side view illustrating the position of the belt tensioner of the present invention for a belt that has lengthened with wear.

A vacuum cleaner 10, shown in FIG. 1 and constructed in accordance with the principles of the present invention, includes a power head 12, coupled to a canister unit 14 through a wand 16, handle 18 and hose 20. Contained in a housing 21 for the power head 12 is a beater brush 22 coupled to a drive motor 24 by a flat, toothless or cogless, non-stretch, endless or continuous belt 26. More specifically, as shown in FIGS. 2 and 3, the belt 26 extends about an output shaft 28 of the motor 24 and about a dowel 30 of the beater brush 22 and, preferably, is seated in a groove formed about the periphery of the dowel 30.

A belt tensioner 32 includes a roller 34 that extends the width of the belt 26; the roller 34 preferably has a groove formed in the periphery thereof in which the belt 26 fits to align the roller 34 with the belt 26. In a particular embodiment, it may be more desirable to mount the motor 24 and the belt 26 and the belt tensioner 32 on the opposite side of the housing 21 from the positions depicted in FIG. 1 for illustrative purposes only. However, the particular location of the components within the housing 21 is not germane to the principles of the present invention.

The roller 34 is coupled between the ends 35 of a pair of connecting arms 36 and 37. The opposite end of each of the connecting arms 36 and 37 is coupled, for pivotal movement about a pivot axis 38, to a respective support 40 extending upwardly from the base 42 of the housing 21. A torsion spring 44 having a free end coupled to the pivot axis 38 and a static end coupled to the fixed support 40 is disposed adjacent to the supports 40 such that the pivot axis 38 extends through the center of the spring 44.

The torsion spring 44 is wound to bias the roller 34 against the belt 26 to cause the roller 34 to exert a force, F, on the belt 26 to tension the belt 26. More particularly, the torsion spring 44 biases the roller 34 against the belt 26 to exert an increasing force thereon as the belt 26 lengthens with wear and the spring 44 unwinds.

As shown in FIG. 2, when the belt 26 is new, the torsion spring 44 biases the roller 34 against the belt 26 to exert a force, $F_1$, normal to the belt 26. The force $F_1$ is equal to $2T_1 \sin(\theta_1/2)$, wherein $T_1$ represents the belt tension and $\theta_1$ represents the belt angle. If the belt tension is equal to 15 lbs. and the belt angle $\theta_1$ is equal to 19.5°, then the force $F_1$ is equal to 5.08 lbs. The moment, $M_1$, of the force, $F_1$, about the pivot axis 38 and thus the moment at the center of the torsion spring 44, is equal to the product of the force, $F_1$, and the moment arm, $L_1$, of the force $F_1$ about the pivot axis 38, i.e., $M_1 = F_1L_1$. If the moment arm $L_1$ shown in FIG. 2 is equal to 0.95 in. and the force $F_1$ is equal to 5.08 lbs., then the moment $M_1$ equals 4.826 in.-lbs.

As shown in FIG. 3, when the belt 26 has lengthened due to wear, the torsion spring 44 biases the roller 34 against the belt 26 to exert a force $F_2$ normal to the belt. The force $F_2$ is equal to $2T_2 \sin(\theta_2/2)$, wherein $T_2$ is the belt tension and 82 is the belt angle. The belt tensioner 32 provides constant tension as the belt lengthens with wear and changes from the new condition depicted in FIG. 2 to the lengthened or worn condition depicted in FIG. 3, that is, $T_1=T_2=15$ lbs. If the belt angle $\theta_2$ for the belt in the slackened condition is equal to 40°, the force $F_2$ must equal 10.26 lbs. for the above constant belt tension relationship to exist.

The moment $M_2$ of the force $F_2$ about the pivot axis 38 and thus at the center of the spring 44 is also equal to $F_2L_2$. If the moment arm $L_2$ is equal to 0.393 inch, then the force $F_2$ is equal to 10.26 lbs. As can be seen from the values $F_1$, $L_1$, $M_1$, $F_2$, $L_2$ and $M_2$, as the belt 26 changes from its new condition (FIG. 2) to its lengthened or worn condition (FIG. 3), the force F normal to the belt 26 increases, the moment arm L of the force F about the pivot axis 38 decreases and the moment M of the force F about the pivot axis 38 decreases in accordance with the spring rate of the spring 44. However, the tension in the belt 26 is automatically maintained constant, eliminating the requirement for adjustments to the belt tension in the initial assembly of the vacuum cleaner 10 or during its use.

The torsion spring 44 preferably has a relatively low spring rate. A suitable torsion spring 44 is an ASTM A229 steel spring having a spring diameter of one inch, wire diameter of 0.08 inch, between 18 and 20 turns and a spring rate of approximately 1.13 in.-lbs./radian. Because the spring rate of the torsion spring 44 is relatively low, the decrease in the moment M as the belt 26 changes from the new condition (FIG. 2) to the lengthened or worn condition (FIG. 3) is slight. For example, if the angle, $\beta$, between the connecting arm 36 and the horizontal, changes from $\beta 1=30°$ to $\beta 2=70°$, for a change of 0.7 radians, the moment M decreases only approximately 0.794 in.-lbs. Therefore, $M_2$ equals approximately 4.032 in.-lbs., that is, $M_1$-0.794 in.-lbs.

The belt tensioner provides tremendous design flexibility. For example, simply by varying the spring rate of the torsion spring 44 to alter the moment at the center of the spring 44 and/or by varying the length of the connecting arms 36 and 37 to vary the maximum moment arm L, a wide range of belt tensions in the belt 26 may be achieved. Furthermore, the uncomplicated nature of the configuration of the belt tensioner 32 (FIGS. 2-3) enables belts 26 to be changed quickly and with ease.

Many modifications and variations of the present invention are possible in light of the above teachings. For example, rather than directly connecting the motor 24 to the brush 22, the belt 26 may connect the output shaft 28 of the motor 24 to an intermediate rotatable member that, in turn, may be connected to the brush 22 by any suitable means, such as another endless belt. In addition, the belt tensioner 32 may be effective in providing substantially constant tension in belts interconnecting other rotatable members of a vacuum cleaner such as the output shaft of a motor of a self-propelled vacuum cleaner to the input shaft of a forward-neutral-reverse transmission or the output shaft of such a transmission to the drive axle of the drive wheels of the vacuum cleaner. Thus, it is to be understood that, within the scope of the appended claims, the invention may be practiced otherwise than as described hereinabove.

What is claimed and desired to be secured by Letters Patent is:

1. A vacuum cleaner comprising:
a canister unit,
a power head including a housing, said housing having an inlet,
a tubular handle connected to said power head,
a conduit connecting said canister unit and said tubular handle for conducting debris from said inlet to said canister unit,
a beater brush disposed within said housing adjacent said inlet,
motor means disposed within said housing having an output shaft coupled to said beater brush for rotating said beater brush,
belt means for coupling said output shaft to said beater brush, said belt means including an endless, non-stretch belt,
a plurality of support arms connected to said housing, and
spring tensioning means pivotally connected to said support arms for providing substantially constant belt tension as said belt lengthens with wear, said spring tensioning means being biased against said belt to exert an increasing force thereon as said belt lengthens with wear.

2. A vacuum cleaner as recited in claim 1 wherein said spring tensioning means includes a torsion spring wound to bias said spring tensioning means against said belt, said torsion spring unwinding as said belt lengthens with wear.

3. A vacuum cleaner as recited in claim 2 wherein said torsion spring has a relatively low spring rate.

4. A vacuum cleaner as recited in claim 3 wherein said spring rate is on the order of approximately 1.13 inch-pounds per radian.

5. A vacuum cleaner comprising:
a canister unit,
a power head including a housing, said housing having an inlet,
a tubular handle connected to said power head,
a conduit connecting said canister unit and said tubular handle for conducting debris from said inlet to said canister unit,
a beater brush disposed within said housing adjacent said inlet,
motor means disposed within said housing having an output shaft coupled to said beater brush for rotating said beater brush,
an endless, flat belt coupling said output shaft to said beater brush, a plurality of support arms connected to said housing, and
tensioning means pivotally connected to said support arms for providing substantially constant belt tension as said belt lengthens with wear, said tensioning means including a roller for engaging said belt and a spring wound to bias said roller against said belt to exert an increasing force on said belt as said belt lengthens with wear and said spring unwinds.

6. A vacuum cleaner as recited in claim 5 wherein said tensioning means further includes means for coupling said roller to said spring at a distance therefrom, said coupling means being pivotable about an axis extending through said spring, the moment of said force about said axis decreasing as said belt lengthens with wear.

7. A vacuum cleaner as recited in claim 6 wherein said spring has a relatively low spring rate so that said moment decreases only slightly as said belt lengthens with wear.

8. A vacuum cleaner comprising:

a canister unit, a power head including a housing, said housing having an inlet, a tubular handle connected to said power head, a conduit connecting said canister unit and said tubular handle for conducting debris from said inlet to said canister unit, a beater brush disposed within said housing adjacent said inlet, motor means disposed within said housing for rotating said beater brush, a belt for coupling said motor means to said beater brush and tensioning means engaging said belt for providing substantially constant belt tension as said belt lengthens with wear, said tensioning means including a roller for engaging said belt, connecting means having a first end coupled to said roller and a second end pivotal about a pivot axis for arcuately moving said roller against said belt and spring means coupled to said connecting means for biasing said roller against said belt to exert an increasing force thereon as said belt lengthens with wear.

9. A vacuum cleaner as recited in claim 8 wherein the moment of said force about said pivot axis decreases as said belt lengthens with wear.

10. A vacuum cleaner as recited in claim 9 wherein said spring means includes a torsion spring having a relatively low spring rate so that said moment decreases only slightly as said belt lengthens with wear.

11. A vacuum cleaner as recited in claim 8 wherein said connecting means includes a pair of connecting arms each having a first end coupled to opposite ends of said roller and having a second end pivotal about a pivot axis.

12. A vacuum cleaner as recited in claim 11 wherein said spring means includes a torsion spring disposed adjacent to the second ends of said connecting arms.

13. A vacuum cleaner as recited in claim 12 wherein said pivot axis extends through said torsion spring.

14. A vacuum cleaner comprising:

a canister unit, a power head including a housing said housing having an inlet, a tubular handle connected to said power head, a conduit connecting said canister unit and said tubular handle for conducting debris from said inlet to said canister unit, a first rotatable member in said housing and connected to a beater brush which is adjacent said inlet, a second rotatable member in said housing and connected to a motor which includes an output shaft for rotating said beater brush, a belt coupling said first rotatable member to said second rotatable member, a plurality of support arms connected to said housing, and spring tensioning means pivotally connected to said support arms for providing substantially constant belt tension as said belt lengthens with wear, said spring tensioning means being biased against said belt to exert an increasing force thereon as said belt lengthens with wear.

15. A vacuum cleaner as recited in claim 14 wherein said spring tension means includes a roller and a torsion spring wound to bias said roller against said belt, said torsion spring unwinding as said belt lengthens with wear.

16. A vacuum cleaner as recited in claim 15 wherein said torsion spring has a relatively low spring rate.

* * * * *